US012018919B2

(12) United States Patent
Milo et al.

(10) Patent No.: US 12,018,919 B2
(45) Date of Patent: Jun. 25, 2024

(54) PORTABLE BALLISTIC SHIELD AND STRETCHER DEVICE

(71) Applicants: Thomas K. Milo, Cuyahoga Falls, OH (US); Angelina L. Milo, Cuyahoga Falls, OH (US)

(72) Inventors: Thomas K. Milo, Cuyahoga Falls, OH (US); Angelina L. Milo, Cuyahoga Falls, OH (US)

( * ) Notice: Subject to any disclaimer, the term of this patent is extended or adjusted under 35 U.S.C. 154(b) by 86 days.

(21) Appl. No.: 17/526,396

(22) Filed: Nov. 15, 2021

(65) Prior Publication Data

US 2022/0196370 A1 Jun. 23, 2022

Related U.S. Application Data

(63) Continuation-in-part of application No. 17/066,539, filed on Oct. 9, 2020.

(60) Provisional application No. 62/912,805, filed on Oct. 9, 2019.

(51) Int. Cl.

| | |
|---|---|
| ***F41H 5/08*** | (2006.01) |
| ***F41H 5/14*** | (2006.01) |
| *F41H 5/24* | (2006.01) |

(52) U.S. Cl.

CPC ..... *F41H 5/08* (2013.01); *F41H 5/14* (2013.01); *F41H 5/24* (2013.01)

(58) Field of Classification Search

CPC ..... F41H 5/08; A61G 1/013

See application file for complete search history.

(56) References Cited

U.S. PATENT DOCUMENTS

| | | | | |
|---|---|---|---|---|
| 2008/0141463 | A1* | 6/2008 | Dionne | A61G 7/05769 5/713 |
| 2015/0283007 | A1* | 10/2015 | Carlson | A61G 1/044 5/625 |
| 2020/0348108 | A1* | 11/2020 | Gonzalez | F41H 5/08 |

* cited by examiner

*Primary Examiner* — J. Woodrow Eldred

(74) *Attorney, Agent, or Firm* — Brennan, Manna & Diamond, LLC

(57) ABSTRACT

A compact, inflatable and portable ballistic shield and stretcher device is disclosed herein. The combination device comprises one or more inflatable panels, a protective cover, one or more straps for handling the combination device, a protective layer, a housing, and an optional wheel assembly for easily transporting the device, and that may also serve as a pump for purposes of inflating the inflatable panels if a source of compressed gas is not readily available. The panels of the portable ballistic shield and stretcher device can be selectively inflated on demand and as needed, and the portable ballistic shield and stretcher device can also be removably attached to other portable ballistic shield and stretcher devices to form a barrier to protect a user from arms fire and other unwanted projectiles.

8 Claims, 19 Drawing Sheets

PORTABLE BALLISTIC SHIELD AND STRETCHER DEVICE

CROSS-REFERENCE TO RELATED APPLICATION

The present application is a continuation in part application of U.S. Provisional application Ser. No. 17/665,539, which was filed on Oct. 9, 2020 and claims priority to, and the benefit of, U.S. Provisional Application No. 62/912,805, which was filed on Oct. 9, 2019 and is incorporated herein by reference in its entirety.

FIELD OF THE INVENTION

The present invention relates generally to an inflatable and portable ballistic shield and stretcher device that can be used to protect a user from small arms fire and other unwanted projectiles. The device of the present invention can also be used as a stretcher to transport, for example, military personnel, patients and other injured parties or supplies. More specifically, the ballistic shield and stretcher device of the present invention is relatively lightweight, compact, durable, easy to transport, deploy and use, and can be inflated by multiple means, a number of which are self-contained. Accordingly, the portable ballistic shield and stretcher device of the present invention is particularly well-suited for military applications, and the present specification makes specific reference thereto. However, it is to be appreciated that aspects of the present invention are also equally amenable to other like applications and devices.

BACKGROUND OF THE INVENTION

Medical backboards have a long history of use in both traditional medical settings, and also in combat and war time settings, for example, to transport the wounded from the battlefield. Unfortunately, traditional medical backboards tend to be heavy, bulky and difficult to carry and store in a combat setting due to their size and rigid nature. For example, most medical backboards are designed to be slightly wider and longer than the average human body, and are comprised of a rigid, planar board with a plurality of handles attached thereto for transporting the backboard and the patient thereon. When one considers the various other gear (and the weight associated therewith) that a soldier or combat medic must carry in a combat setting, it is readily apparent that it is relatively difficult and awkward for the soldier or medic to also transport a relatively long, wide, rigid, planar object such as a medical backboard.

Additionally, different medical backboards may be needed for different types of combat settings to help camouflage the soldier or combat medic from the enemy. For example, a medical backboard having a camouflaged pattern may be desirable for use in a forested environment, whereas a tan medical backboard may be more useful in a desert deployment. Having to procure, transport and store multiple types of medical backboards for different applications can be both costly and time-consuming for the military.

Further, traditional medical backboards do not have wheels and typically a plurality of medical personnel are required to carry both the medical backboard and the patient or soldier thereon, oftentimes across difficult terrain and in challenging weather conditions. Further, if multiple personnel are not available to carry the medical backboard in the traditional manner, a single user may be forced to drag the patient/soldier on the backboard, which is not only difficult and laborious, but can also lead to further injury to the patient as the medical backboard is dragged along uneven terrain, or damage to the medical backboard.

Moreover, in a combat setting, oftentimes patient extractions from the battlefield are performed under duress and/or enemy fire. Unfortunately, traditional medical backboards, which are oftentimes made from wood or plastic, offer soldiers and medical personnel very little protection from enemy fire and other dangerous projectiles. Additionally, when said traditional medical backboards do come into contact with enemy fire and/or such projectiles, the same are oftentimes damaged and must be discarded and replaced, which can be expensive.

Therefore, there is a long felt need in the art for a portable and inflatable ballistic shield and stretcher device that is relatively easy to store, transport, deploy and use by a single individual, and that can readily be removably attached to a plurality of other inflatable ballistic shield and stretcher devices to form a barrier. Moreover, there is a long felt need in the art for a portable and inflatable ballistic shield and stretcher device comprised of at least one, and preferably two or more, inflatable chambers, each of which can be selectively inflated on demand and as needed. There is also a long felt need in the art for a portable and inflatable ballistic shield and stretcher device that can afford both the user and the patient being transported thereon protection from enemy fire and other dangerous projectiles. Additionally, there is a long felt need in the art for a portable and inflatable ballistic shield and stretcher device that can be readily adaptable to its surroundings, and that does not necessarily need to be discarded and replaced each time it comes into contact with chemical agents or bodily fluids, or suffers damage (e.g., from use, enemy fire, or the like).

The present invention discloses a compact and inflatable ballistic shield and stretcher device that is configured for relatively easy storage, transport, deployment and use by a single user. The ballistic shield and stretcher device of the present invention is readily adaptable to its surroundings, and does not necessarily need to be discarded and replaced each time it comes into contact with chemical agents or bodily fluids, or suffers damage. Additionally, the various compartments of the ballistic shield and stretcher device of the present invention are capable of being inflated/deflated in a combat or other remote setting, on demand, by a number of different self-contained means. In a deflated state, the device may function as a stretcher, as opposed to a rigid ballistic shield, and can also be used as a ballistic blanket. Finally, the ballistic shield and stretcher device of the present invention can also be used as an offensive or defensive shield to protect the user and/or the patient being transported thereon from enemy fire and other dangerous projectiles.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises am inflatable ballistic shield and stretcher device for both providing cover from small arms fire and also for transporting an injured individual, such as a soldier or other military personnel, in a combat setting. The inflatable ballistic shield and stretcher device is compact, durable, lightweight and relatively easy to store, transport, deploy, and use, and can be inflated on demand by a number of different techniques as explained more fully below. Further, the ballistic shield and stretcher device of the present invention can also be used as an offensive or defensive shield against unwanted projectiles, such as small arms fire and the like, as explained more fully below.

More specifically, in one embodiment of the present invention, the ballistic shield and stretcher device comprises one or more inflatable panels, a protective cover, one or more straps for handling the inflatable panels, a protective layer, a housing and a wheel assembly for easily transporting the device, that also serves as a pump for purposes of inflating the panels. The inflatable panels and the protective layer are preferably enclosed within the protective cover, which shields the same from damage while being transported and/or used. Further, if the protective cover becomes damaged or comes into contact with undesirable chemical agents or bodily fluids, it can be easily replaced, as opposed to having to replace the entire portable ballistic shield and stretcher device. Additionally, the protective cover can be manufactured in a number of different colors, styles and/or designs depending on the particular application or user preference to make the device easily adaptable to its surroundings. For example, a protective cover having a camouflaged pattern can be useful in a forested environment for camouflaging the device and its user from the enemy, whereas a tan protective cover may be more desirable and useful in a desert deployment.

In a preferred embodiment of the present invention, the housing and the wheel assembly can be used to transport a container of compressed gas or to directly inflate the inflatable ballistic shield and stretcher device. More specifically, the wheel assembly can also serve as a pump that can be used to inflate the medical backboard when a canister of compressed gas or other air supply is not readily available, as explained more fully below. Alternatively, the housing can be used to store a container of compressed gas or other medical supplies, and preferably comprises a valve and a valve selector switch which permits a user to easily inflate, deflate or maintain the pressure contained within the inflatable medical backboard of the present invention. Alternatively, the container(s) of compressed gas may be positioned elsewhere along the device, as explained more fully below.

In an alternative embodiment, a portable ballistic shield and stretcher device is described. The device comprises one or more inflatable panels, a protective cover, one or more straps for handling the combination device, a protective layer, a housing, an inflation means and an attachment. The inflatable panels, straps and inflation means of the combination device are substantially the same as described above. However, the panels of the portable ballistic shield and stretcher device can be selectively inflated on demand as needed, and the portable ballistic shield and stretcher device can also be removably attached to other portable ballistic shield and stretcher devices to form a barrier to protect a user from, but not limited to, small arms fire and other unwanted projectiles.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE FIGURES

While the specification concludes with claims particularly pointing out and distinctly claiming the present invention, it is believed that the present invention will be better understood from the following description in conjunction with the accompanying Figures, in which like reference numerals identify like elements, and wherein:

DETAILED DESCRIPTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

As previously stated, there is a long felt need in the art for a portable and inflatable ballistic shield and stretcher device that is relatively easy to store, transport, deploy and use by a single individual, and that can readily be removably attached to a plurality of other inflatable ballistic shield and stretcher devices to form a larger barrier. Moreover, there is a long felt need in the art for a portable and inflatable ballistic shield and stretcher device comprised of at least one, and preferably two or more inflatable chambers or panels, each of which can be selectively inflated on demand as needed. There is also a long felt need in the art for a portable and inflatable ballistic shield and stretcher device that can afford both the user and the patient being transported thereon protection from enemy fire and other dangerous projectiles. Additionally, there is a long felt need in the art for a portable and inflatable ballistic shield and stretcher device that can be readily adaptable to its surroundings, and that does not necessarily need to be discarded and replaced each time it comes into contact with chemical agents or bodily fluids, or it suffers damage (e.g., from use, enemy fire, or the like).

Figure 1:
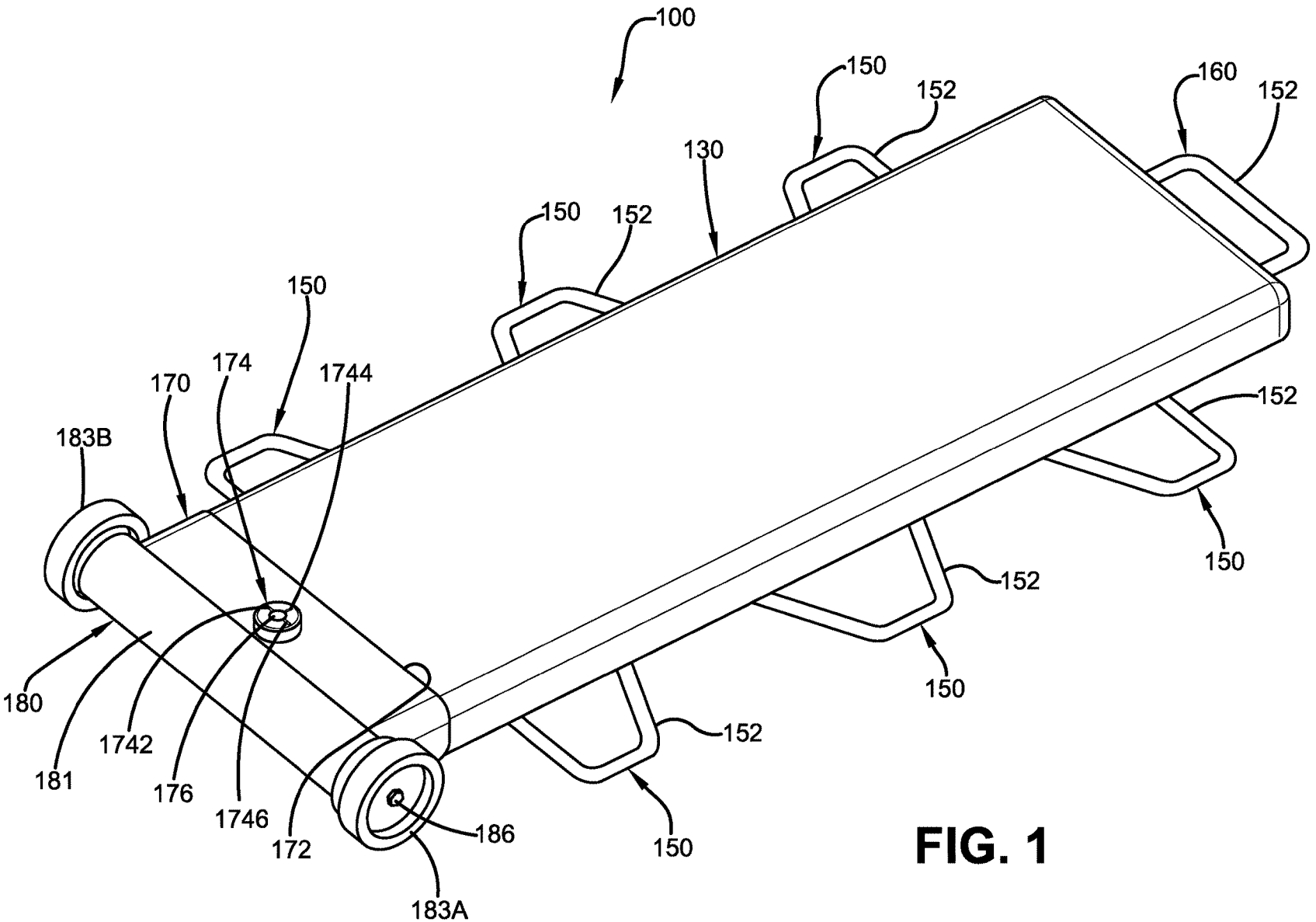
FIG. 1 illustrates a top perspective view of one potential embodiment of the improved medical backboard device of the present invention in an inflated state.

Turning now to the drawings, FIG. 1 illustrates a top perspective view of one potential embodiment of the improved medical backboard device 100 of the present invention in an inflated state. More specifically, the improved medical backboard device 100 is preferably comprised of an inflatable member 110, a protective cover 130, a protective layer 140, a lateral strap assembly 150, a longitudinal strap assembly 160, a housing 170 and a wheel assembly 180.

Figure 6:
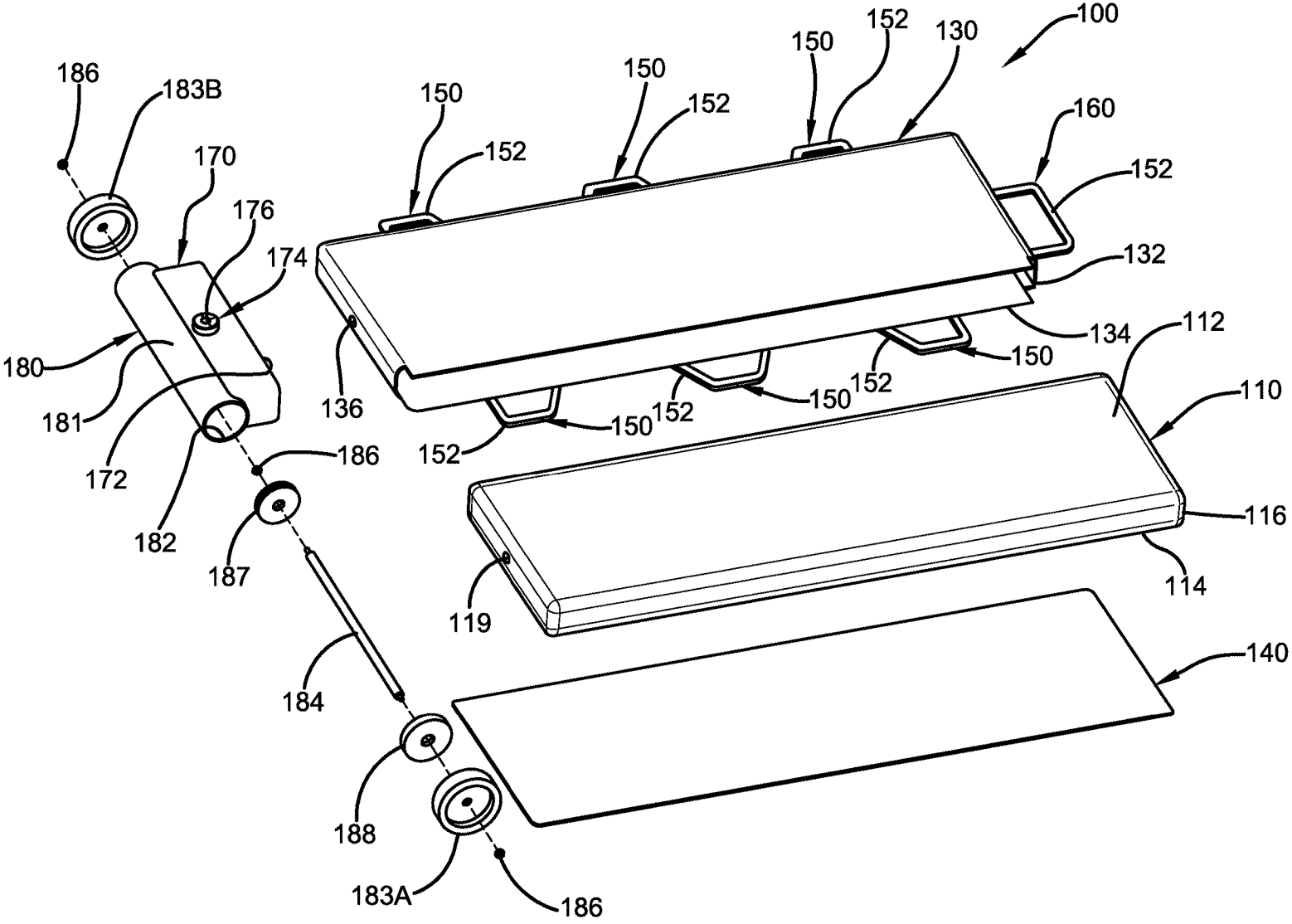
FIG. 6 illustrates a partially exploded top perspective view of the improved medical backboard device of FIG. 1.
Figure 9:
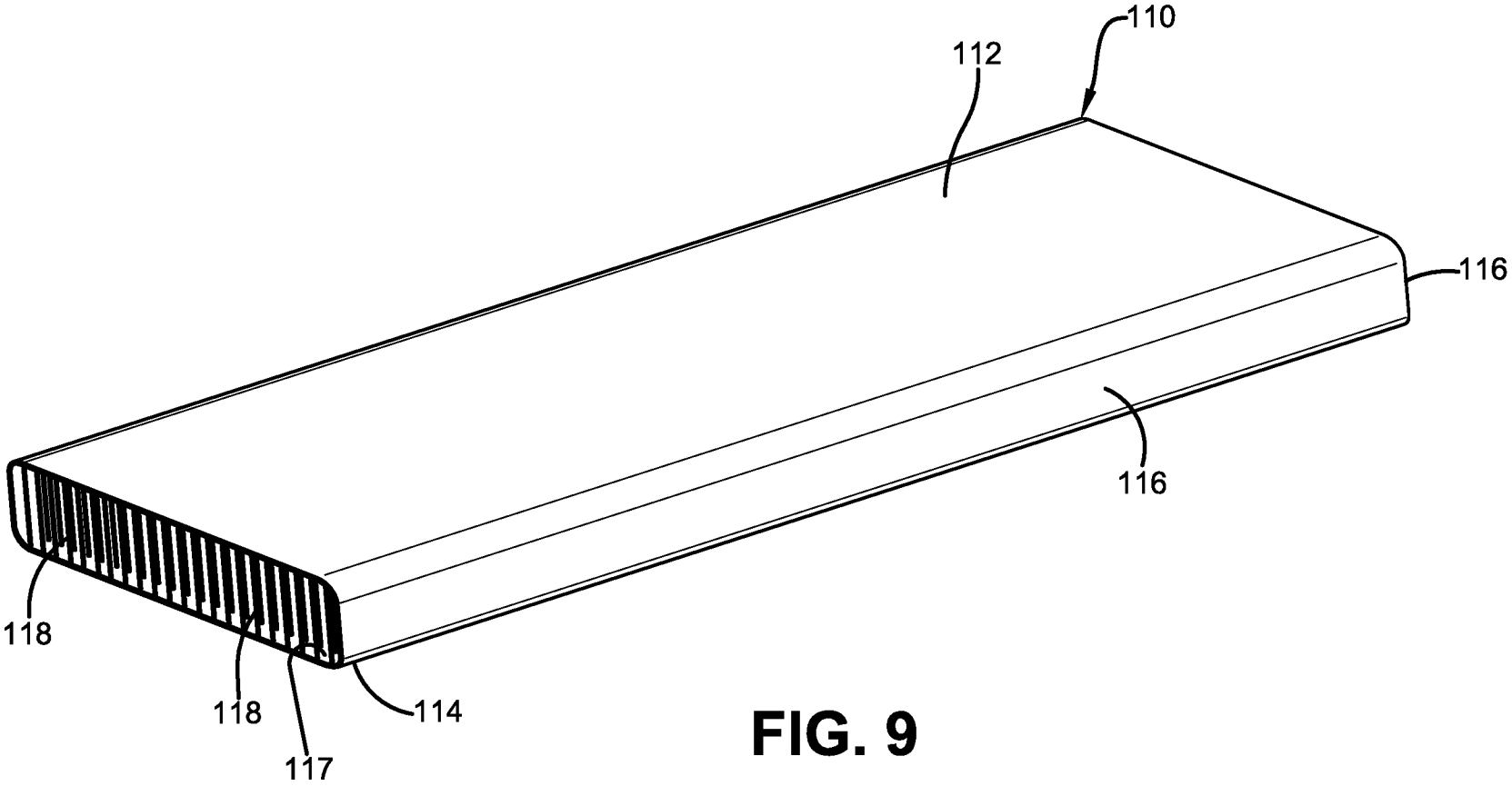
FIG. 9 illustrates a perspective view of one end of the inflated medical backboard partially cut away to show the interior of the same.

As best shown in FIGS. 6 and 9, the inflatable member 110 is preferably comprised of a top 112, a bottom 114, a plurality of sides 116 connecting said top 112 to said bottom 114 to form an airtight interior 117, a plurality of filaments 118 extending between said top 112 and bottom 114, and a port 119 that can be used to inflate and/or deflate the inflatable member 110. It is contemplated that inflatable member 110 can be inflated/deflated on demand, thereby making it much easier to store and transport the device 100 in a compact manner when not in use. More specifically, when the inflatable member 110 is in a deflated state, it may be wrapped around or stored within the housing 170, thereby vastly reducing the overall footprint of the medical backboard device 100 and conserving storage/transportation space.

As explained more fully below, the inflatable member 110 is preferably inflated with compressed air, but it is contemplated that other materials, liquids or gases could also be used without affecting the overall concept of the present invention. It is further contemplated that the port 119 can be positioned virtually anywhere along backboard 110, though it is preferably positioned on the side 116 that is inserted into the housing 170 so that it may be placed in fluid communication with a port 178 contained therein, as explained more fully below.

The inflatable member 110 is preferably inflated to between 10 and 20 psi, though it is contemplated that other pressures can also be utilized to suit user preference without affecting the overall concept of the present invention. For example, it is also contemplated that the inflatable member 110 could be deflated (completely or partially) to cup or conform to the body shape of the individual being transported thereon. When properly inflated, the plurality of filaments or fibers 118 that span the interior between the top 112 and the bottom 114 are placed in tension, thereby providing added strength and support to the inflated backboard 110, and causing it to remain generally flat or planar. It is also contemplated that the plurality of filament or fibers 118 could be used to connect opposing sides 116 instead of the top 112 and bottom 114.

The inflatable member 110 may be constructed of many different types of materials such as fabric-reinforced high density polyethylene, polyvinyl chloride (PVC), plastic or any other suitable material types such as those used in children's bouncing jumpers. The material can be thin sheets such as 30 oz./yd$^2$ to 80 oz./yd$^2$ fabric weight, or any other suitable thickness or shape.

Figure 7:
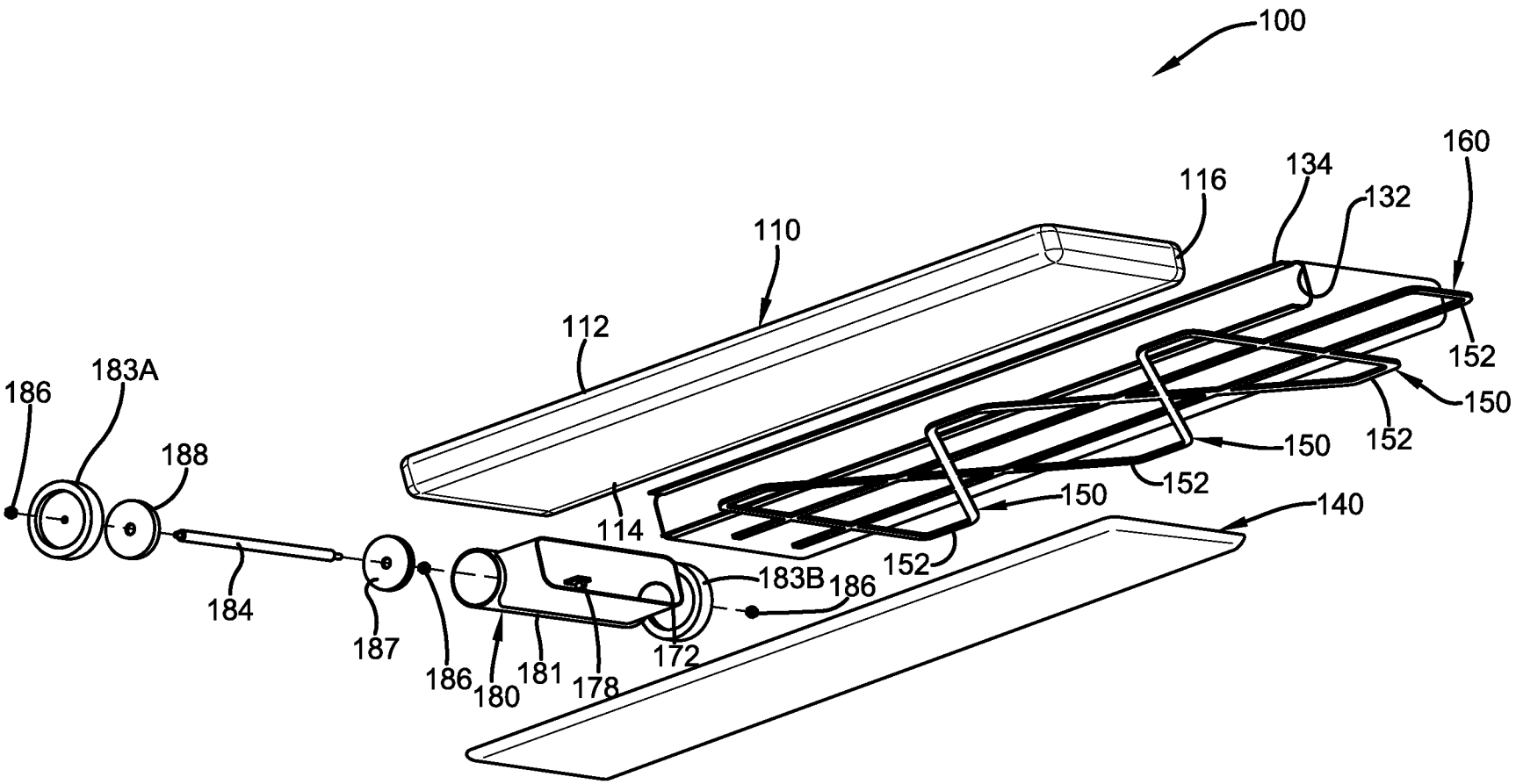
FIG. 7 illustrates a partially exploded bottom perspective view of the improved medical backboard device of FIG. 1.
Figure 8:
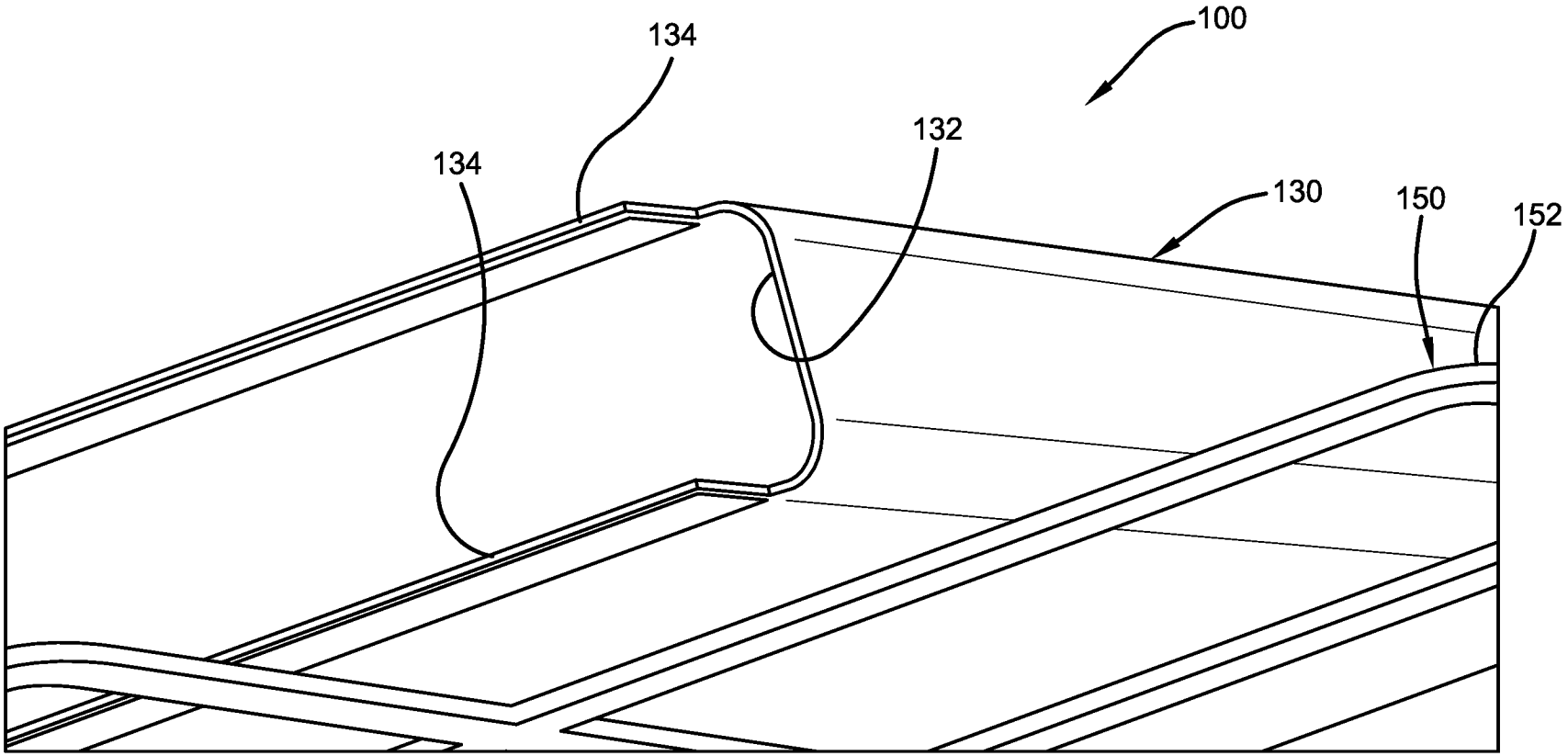
FIG. 8 illustrates a partial perspective view of one end of the inflatable medical backboard partially enclosed in the protective sleeve.

As best shown in FIGS. 6-8, the protective cover 130 is an envelope-type structure that is preferably comprised of an opening 132 for receipt of the inflatable member 110 and protective layer 140, as explained more fully below, a flap 134 for enclosing and securing the inflatable member 110 and protective layer 140 within the protective cover 130, and a port opening 136 to permit the port 119 of the inflatable member 110 to be in fluid communication with the housing 170, as explained more fully below. Flaps 134 may be secured to one another by any type of commonly-known enclosing means such as hook and loop fasteners (i.e., Velcro®), a zipper, button snaps and the like.

The protective cover 130 is preferably vinyl-coated though it does not need to be, and may be comprised of other materials such as a ballistic-resistant material. The protective cover 130 is useful for shielding the inflatable member 110 and protective layer 140 from damage while the device 100 is being transported and/or used. For example, the protective cover 130 will typically protect the inflatable member 110 from being punctured by rocks, sticks, ground cover and other sharp objects as the device 100 is being utilized. Further, if the protective cover 130 becomes damaged or subjected to chemical or biological agents such as blood, urine or other bodily fluids, it can be easily replaced, as opposed to having to replace the entire medical backboard device 100, which could be both time-consuming and expensive. Additionally, the protective cover 130 is easily adaptable to its surroundings and can be manufactured in a number of different colors and/or designs, depending on the particular application and/or to suit user preference. For example, a camouflaged pattern may be desirable for camouflaging a user from the enemy in a forested or jungle-like environment, whereas a tan protective cover may be more desirable in a desert environment.

As best shown in FIGS. 6-7, the protective layer 140 can be positioned immediately adjacent to the inflatable member 110 (preferably next to the bottom 114) within the protective cover 130 to provide an additional layer of protection to the inflatable member 110, the user and the patient. More specifically, the protective layer 140 is preferably comprised of a plurality of detached or detachable layers of a ballistic-resistant material including, but not limited to a Kevlar® material, thereby enabling the user (not shown) to also use the medical backboard device 100 as a one-handed defensive or offensive shield. The Kevlar® material is preferably layered in such a manner as to possess a minimum ballistic resilience rating of NIJ IIIA. For example, a user dragging a patient or soldier on the medical backboard device 100 will have protection along the underside of the backboard device 100 from incoming enemy fire and/or other sharp objects due to the presence of the protective layer 140. Further, in an offensive setting, a user may use the backboard device 100, with the protective layer 140 being positioned between the enemy and the inflatable member 110, as a one-handed offensive shield (e.g., the user can position his or her forearm through the handles 152 of the lateral strap assembly 150) and enabling the user to use his or her other hand to, for example, return fire to an enemy. Additionally, because the protective layer 140 is preferably comprised of a plurality of detached or detachable layers of ballistic resistant materials, should one or more of the layers become damaged, the damaged layers can be relatively easily replaced without having to discard the entire protective layer 140, which could be both time-consuming and expensive. By way of example and not limitation, it is contemplated that the protective layer 140 could be comprised of approximately twenty layers of Kevlar® material. Also, the immediately adjacent presence of the inflatable member 110 helps to absorb and distribute the shock and impact forces of small arms fire and other projectiles, thereby reducing the potential for damage to the protective layer 140 and end user soft tissue damage.

Figure 2:
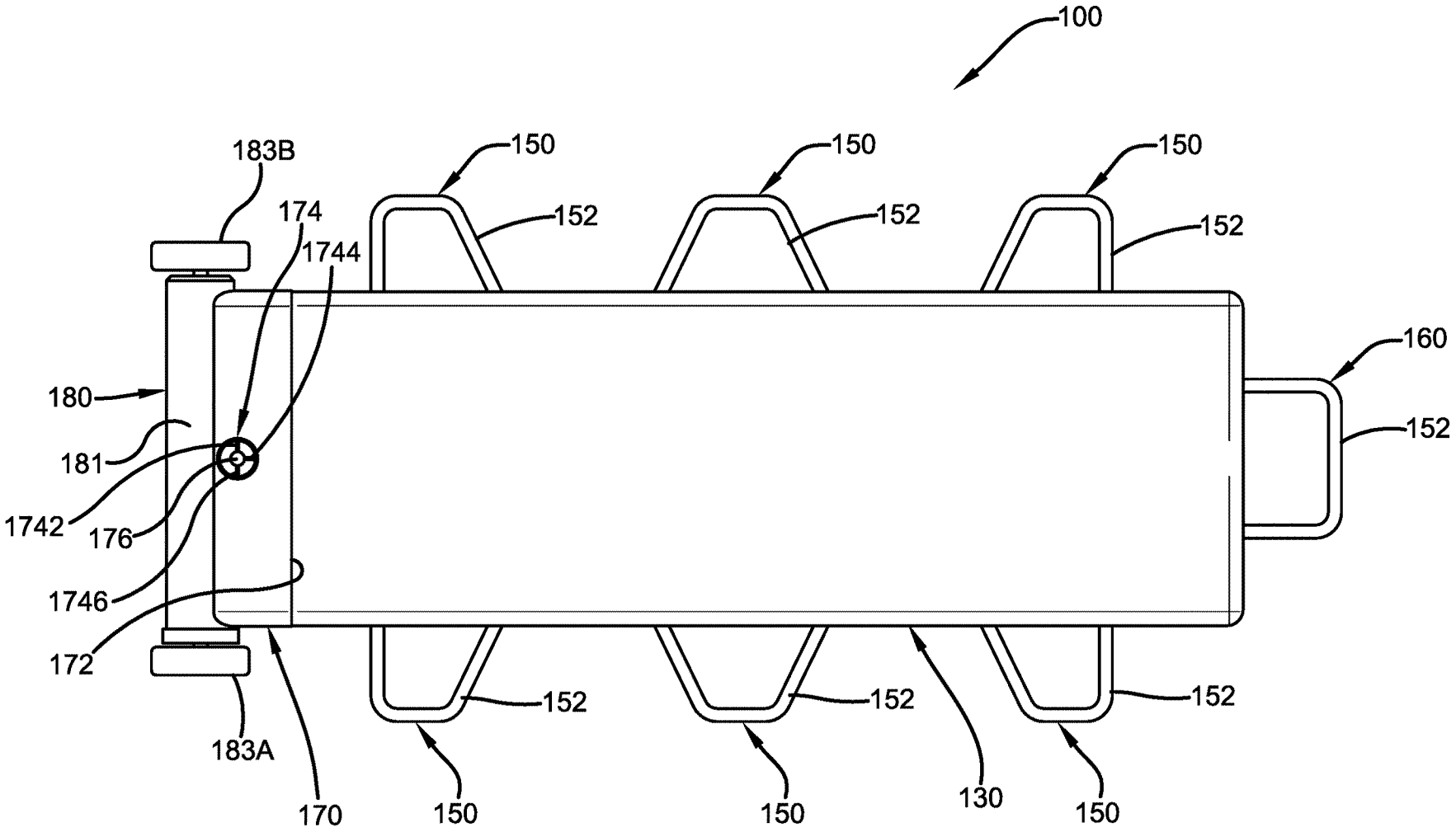
FIG. 2 illustrates a top view of the improved medical backboard device of FIG. 1.
Figure 3:
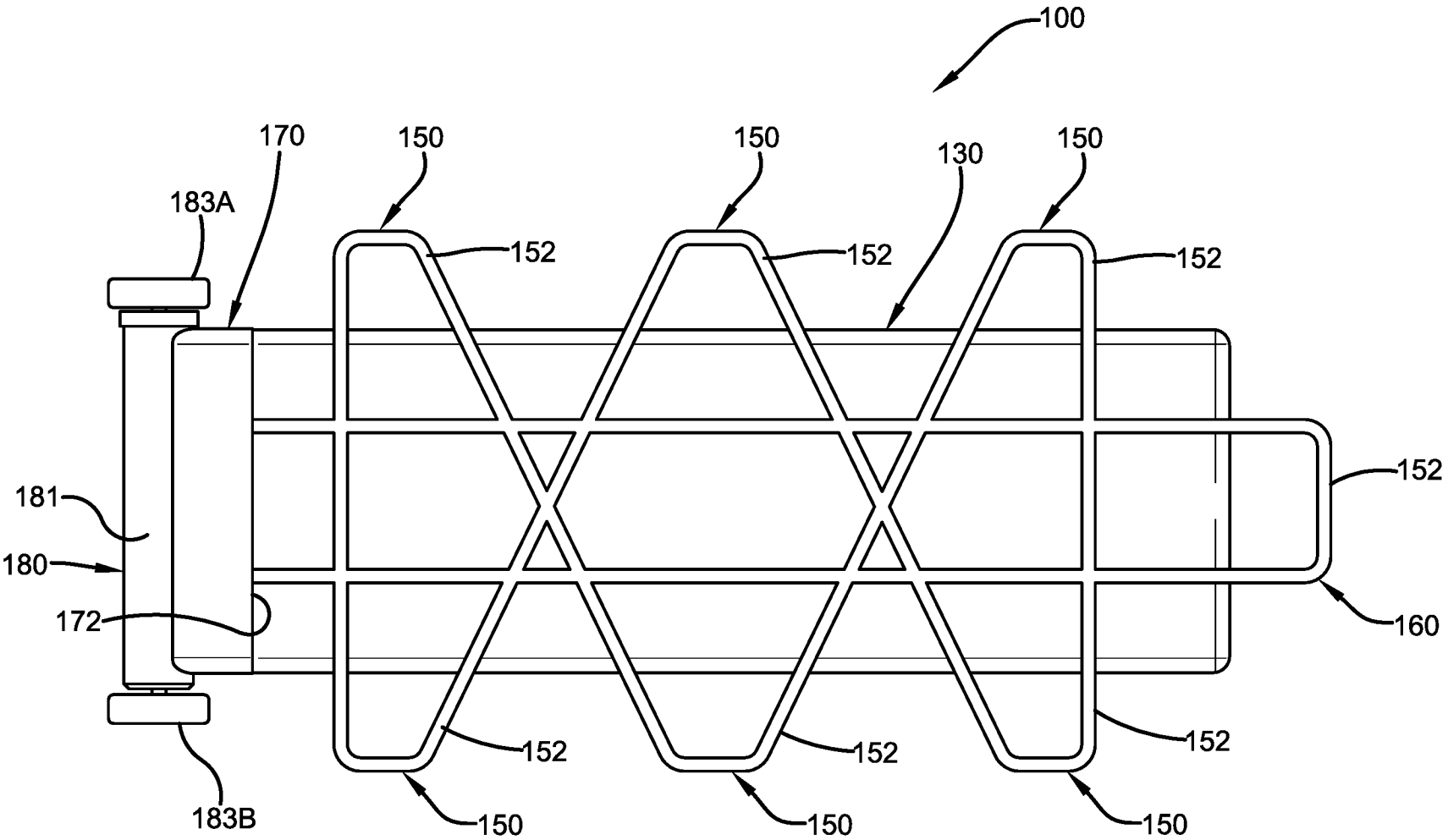
FIG. 3 illustrates a bottom view of the improved medical backboard device of FIG. 1.
Figure 4:
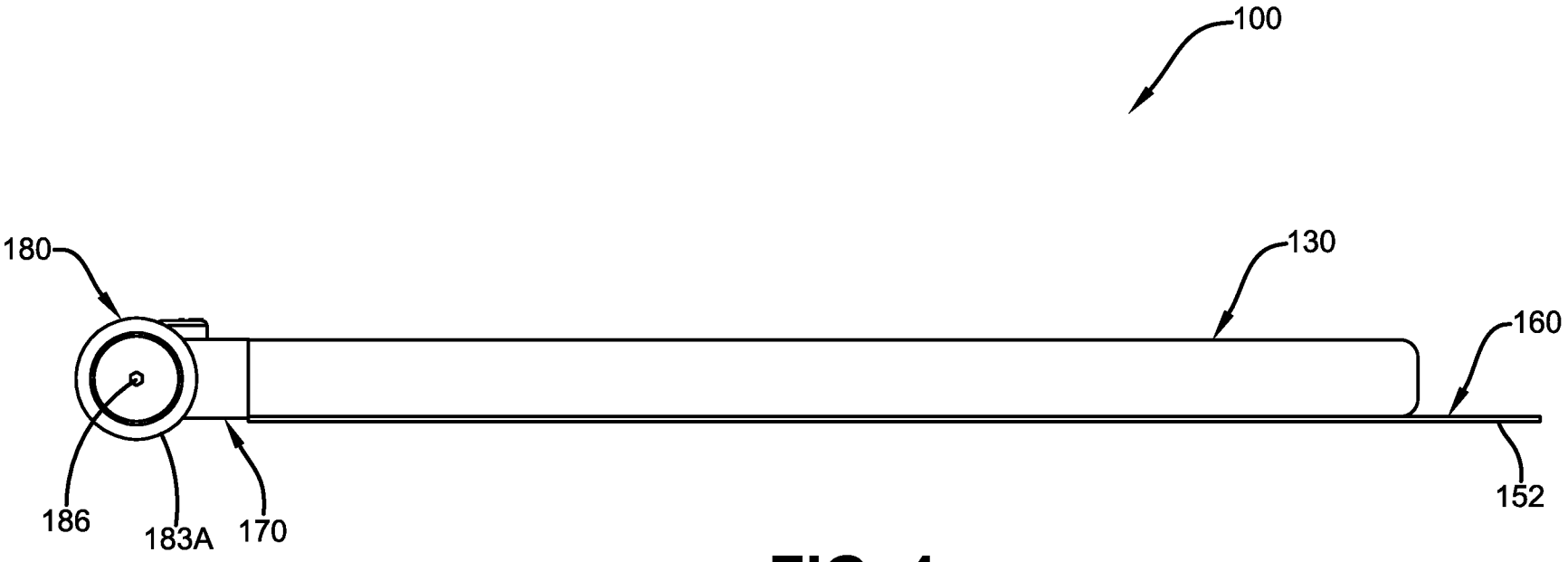
FIG. 4 illustrates a side elevational view of the improved medical backboard device of FIG. 1
Figure 5:
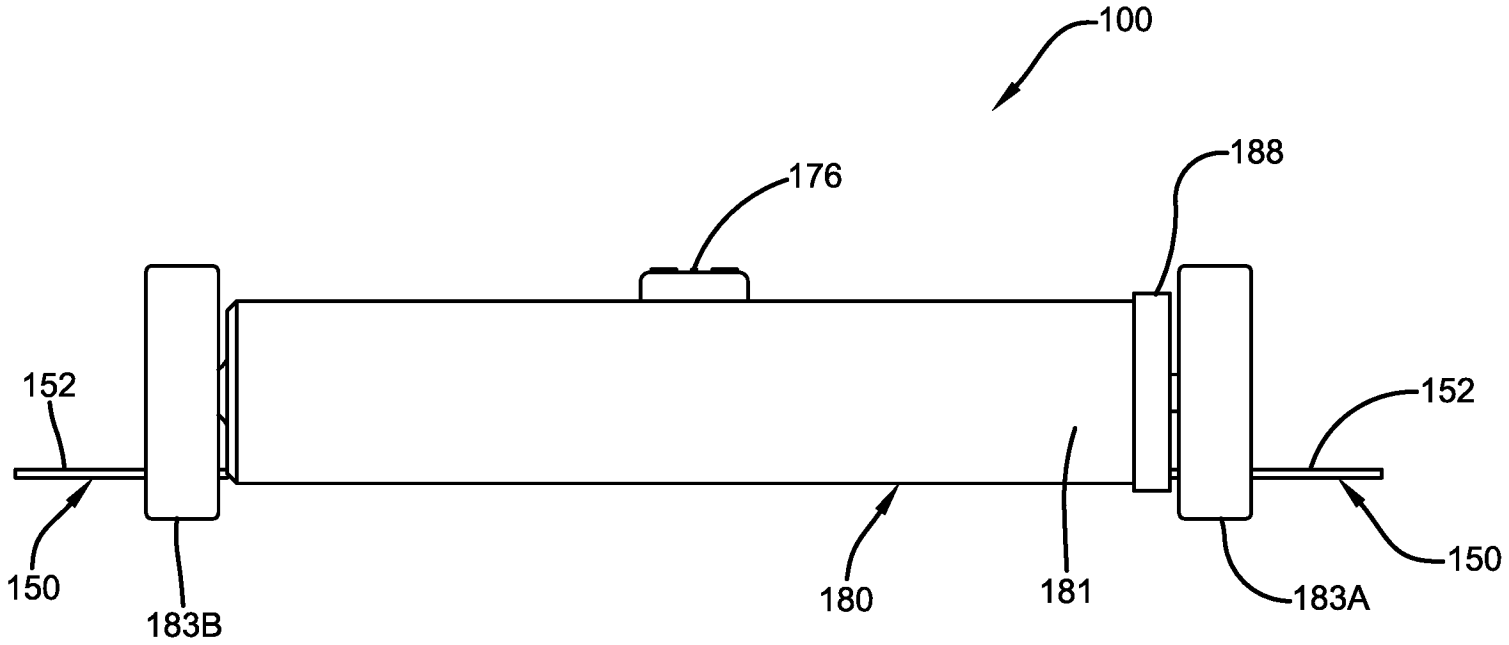
FIG. 5 illustrates a rear elevational view of the improved medical backboard device of FIG. 1
Figure 11:
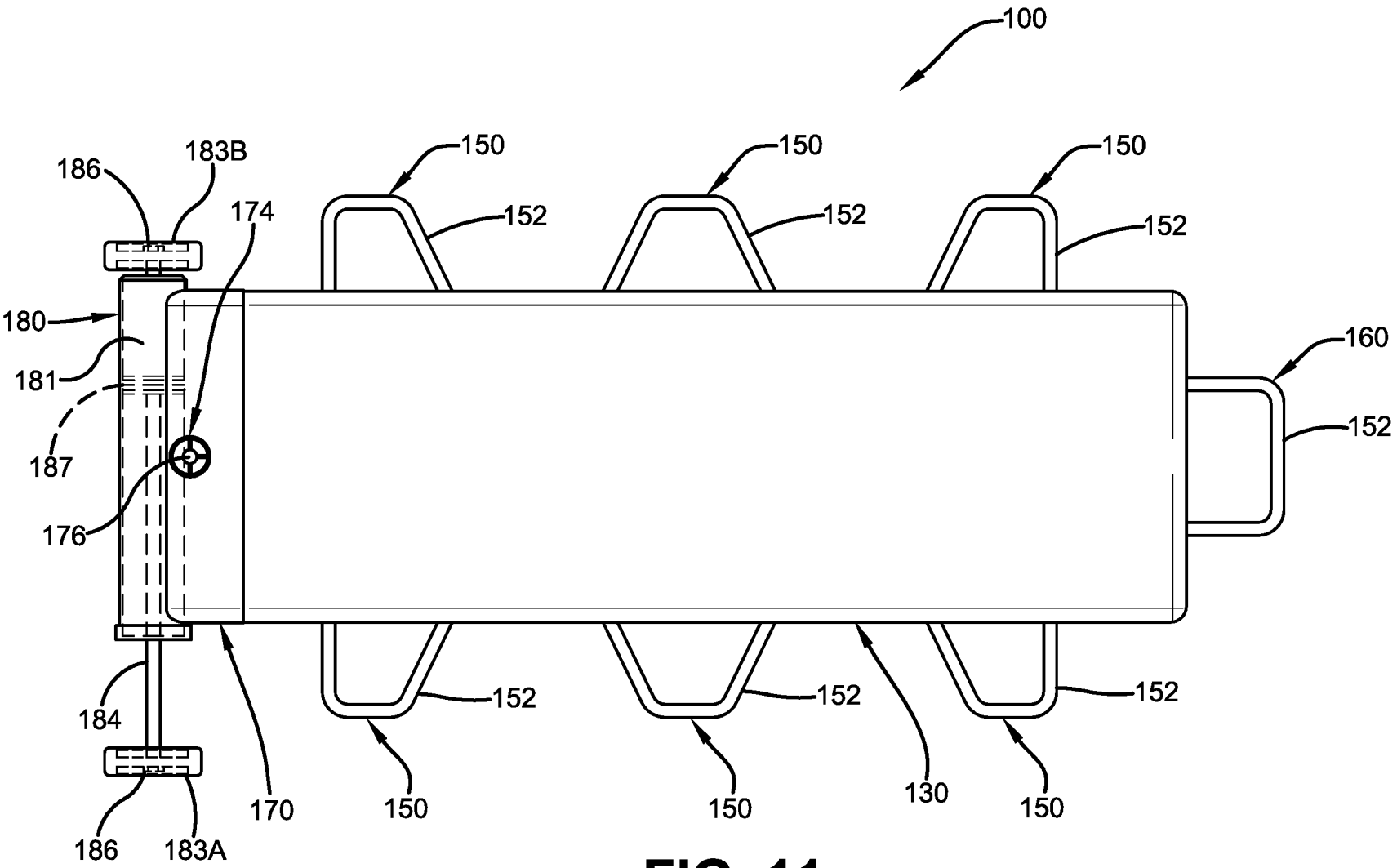
FIG. 11 illustrates a perspective view of the improved medical backboard device of FIG. 1 with hidden lines to show certain interior features and with the wheel/pump handle extended and ready to be compressed (i.e., in an upstroke position).

As best shown in FIGS. 2 and 3, the lateral strap assembly 150 is preferably an elongated nylon strap that can be positioned in a cross-member configuration along, and attached to, the underside of the protective cover 130 to form a plurality of handles 152. The handles 152 can be used to transport an injured individual, such as a soldier, from the battlefield to safety. Further, as best shown in FIGS. 2 and 3, the longitudinal strap assembly 160 is also preferably an elongated nylon strap that can be positioned longitudinally along, and attached to, the underside of the protective cover 130 to form an additional handle 152 that can be used to pull the device 100 longitudinally to take advantage of the presence of the wheel assembly 180, as described more fully below. Alternatively, it is also contemplated that additional (or fewer) lateral straps/handles and longitudinal straps/handles can be used with the device 100, and that the longitudinal strap assembly 160 can be configured to comprise two separate handles 152, one positioned on each longitudinal end of the device 100. Each of the lateral strap assembly 150 and the longitudinal strap assembly 160 can be attached to the underside of the protective cover 130 by any means commonly known in the art, such as via stitching, adhesives, plastic welding, etc. Alternatively, each of the lateral strap assembly 150 and the longitudinal strap assembly 160 may be housed within the interior of protective cover 130, as best shown in FIG. 11. Additionally, it is also contemplated that other strap assemblies (not shown) could be included as well to, for example, secure the patient to the medical backboard device 100 during transportation.

As best shown in FIGS. 1, 6 and 7, the housing 170 is preferably a box-like structure that is comprised of an opening 172 therein for receipt of at least a portion of the protective cover 130, inflatable member 110, protective layer 140, a valve mode selector 174, an intake port 176 and an exit port 178. The intake port 176 is in fluid communication with the exit port 178, and permits the introduction of a compressed gas, such as air, from an external source such as air supply (not shown), a compressed gas canister (not shown) or from the wheel assembly 180, which may also serve as a pump as explained more fully below, to inflate the inflatable member 110 via the exit port 178, which is in fluid communication with the port 119. Further, the valve mode selector 174 preferably has at least the following three settings, namely, "inflate" 1742 to permit the introduction of a compressed gas to inflate the inflatable member 110, "deflate" 1744 to permit the deflation of the inflatable member 110, and "closed" 1746 to permit the inflatable member 110 to remain in an inflated state. As previously stated, the housing 170 is also useful for storing and transporting the inflatable member 110 in a deflated state, a cylinder of compressed gas (not shown) or other items, such as medical supplies, medicine, a first aid kit or the like.

As best shown in FIGS. 1-7 and 10-11, the wheel assembly 180 is attachable to the housing 170, and is preferably comprised of a cylinder 181 having an opening 182 therein, a pair of spaced-apart wheels 183A and 183B, a rod or axle 184, one or more nuts or other fasteners 186, a piston 187 having roughly the same exterior diameter as the interior diameter of the cylinder 181, and that is attached to said rod 184, and a cap 188 removably attached to one end of the cylinder 181. More specifically, the respective ends of the rod 184 may be threaded for receipt of nuts 186, and to secure the wheel 183A and piston 187, which are positioned there along. Each of the rod 184 and the piston 187 are preferably housed within the cylinder 181, which may be sealed in an airtight manner by the removable cap 188, and the wheel 183A is rotatably attached to the rod 184 and secured thereon by the nut 186. Wheel 183B is rotatably-attached to the cylinder housing 181. The presence and positioning of the wheels 183A, B on the wheel assembly 180 at one end of the device 100 permits a user to use the longitudinal strap assembly 160 at the opposite end of the device 100 to pull the medical backboard device 100 along a ground surface, thereby making for easier handling of the medial backboard device 100 and transporting of an injured individual, such as a soldier, positioned thereon (not shown).

Figure 10:
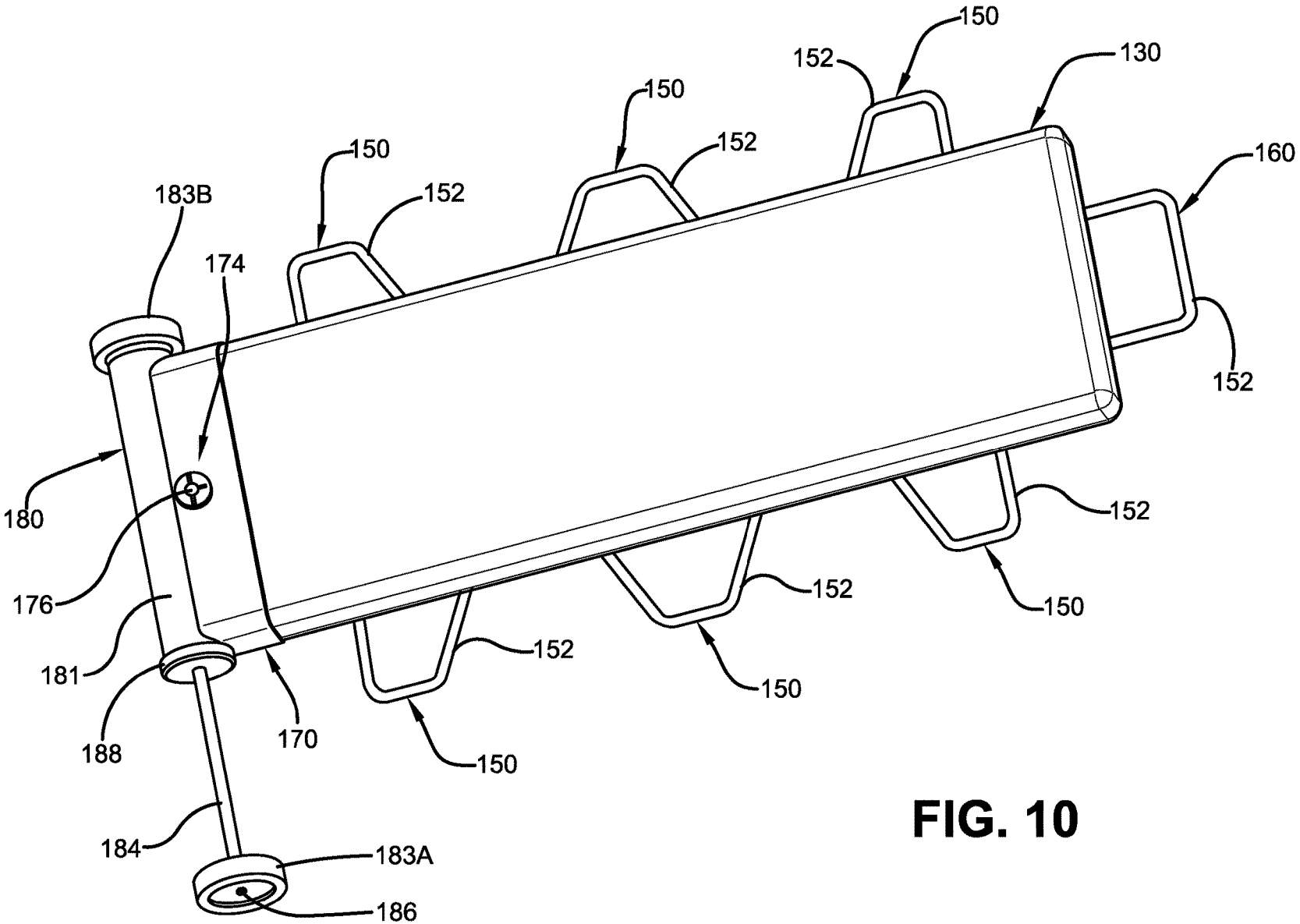
FIG. 10 illustrates a perspective view of the improved medical backboard device of FIG. 1 with the wheel/pump handle extended and ready to be compressed (i.e., in an upstroke position).

Additionally, should a source of compressed gas not be readily available to inflate the inflatable member 110 when needed, a user can use the wheel assembly 180 as a pump. More specifically, and as best shown in FIGS. 10-11, a user can pull the wheel 183A in a direction opposite of the opposing wheel 183B, thereby causing the piston 187 to move within the cylinder 181 in the direction of the removable cap 188, and then reverse direction to create a compressive force, similar to that of an air pump, within cylinder 181 that can in turn be used to inflate the inflatable member 110 via the various ports referenced above. Further, when fully inserted into the cylinder 181 (i.e., in a downstroke position), the piston 187 and wheel rod 184 can be locked into position to prevent the same from inadvertently and undesirably travelling in an upstroke direction when the device 100 is in use.

In a further embodiment of the present invention, the wheel assembly 180 may be eliminated and replaced with a pocket or sleeve (not shown) attached to protective cover 130 for housing a container of compressed gas (not shown)

therein. More specifically, the container of compressed gas can be in fluid communication with the port 119 of the inflatable member 110 for purposes of inflating the same. Additionally, when not in use, the protective cover 130 and its contents, namely the deflated member 110 and protective layer 140, may be wrapped around the container of compressed gas to protect and transport the same.

Figure 12:
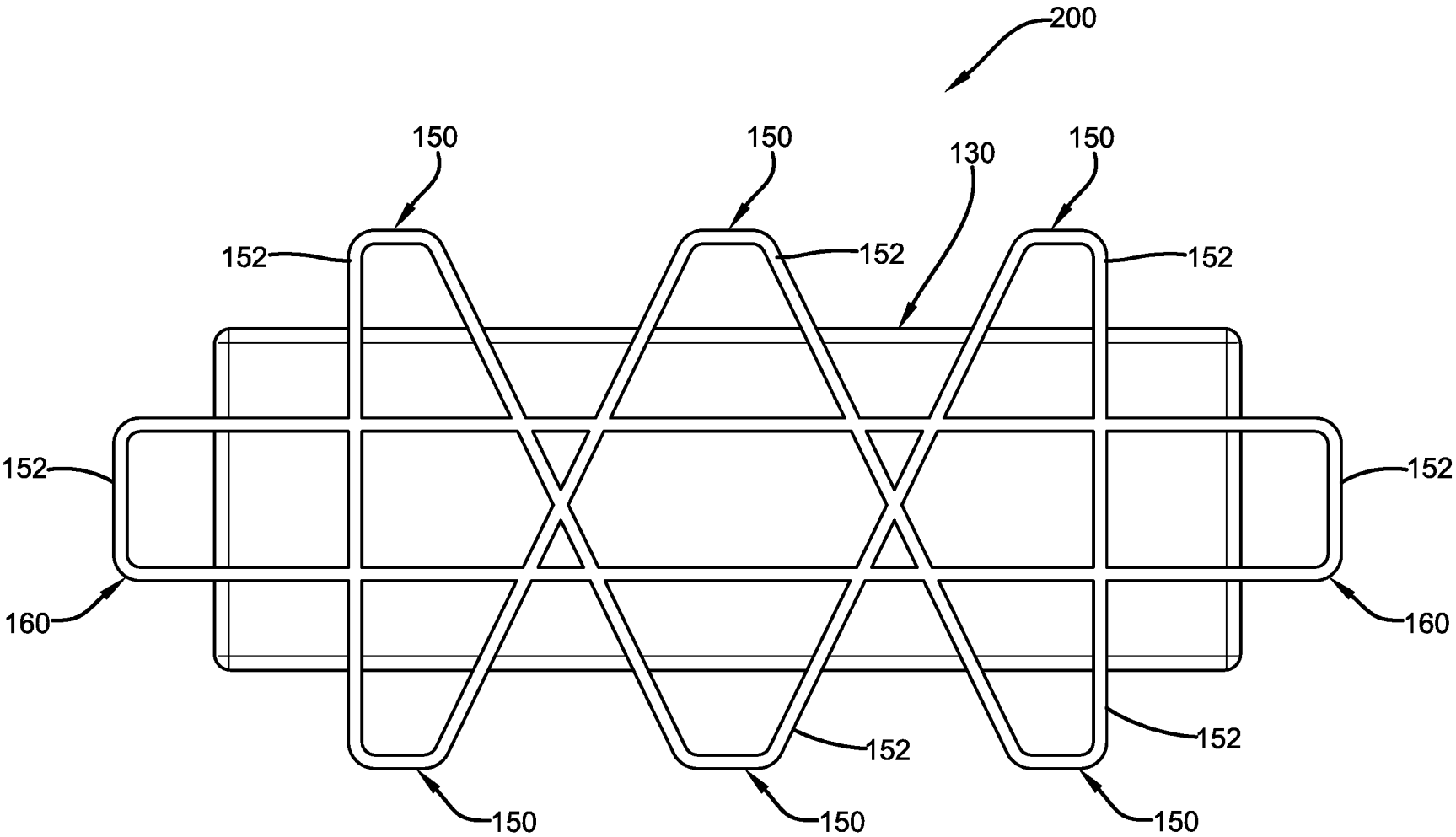
FIG. 12 illustrates a front view of an alternative embodiment of a portable ballistic shield and stretcher device of the present invention.

FIG. 12 illustrates a front view of an alternative embodiment of a portable ballistic shield and stretcher device 200 of the present invention. Similar to the improved medical backboard device 100 described above, the device 200 is preferably comprised of one or more (and preferably two) inflatable members 110, the protective layer 140, the lateral strap assembly 150, the longitudinal strap assembly 160, an inflation means and an attachment means, as described more fully below. The device 200 may also comprise the protective cover 130, as described more fully above.

As best shown in FIGS. 6, 9, 12 and 13 and explained more fully above, each of the inflatable members 110 is preferably comprised of a top or front 112, a bottom or rear 114, a plurality of sides 116 connecting said front 112 to said rear 114 to form an airtight interior 117, a plurality of filaments 118 extending between said front 112 and rear 114, and a port or valve 119 that can be used to inflate and/or deflate the inflatable member 110. It is contemplated that each of the inflatable members 110 can be inflated/deflated on demand, thereby making it much easier to store and transport the device 200 in a compact manner when not in use. More specifically, when one or more of the inflatable members 110 is in a deflated state, it may be wrapped up (see e.g., FIG. 16) to vastly reduce the overall footprint of the device 200, prevent tripping hazards and conserve storage/transportation space.

As explained above, each of inflatable members 110 is preferably inflated with compressed air, but it is contemplated that other materials, liquids or gases could also be used, without affecting the overall concept of the present invention. It is further contemplated that port 119 can be positioned virtually anywhere along the inflatable member 110, though it is preferably positioned on the side 116 that faces the other inflatable member 110, so that it may be placed in fluid communication with a supply of compressed gas, positioned therebetween as described more fully in relation to FIG. 13 below. The inflation pressure and materials used to construct each of inflatable members 110 are substantially as described above.

As best shown in FIGS. 6-7, 12 and 13, the protective layer 140 can be positioned immediately adjacent to the inflatable members 110 (preferably next to the bottom 114) to provide an additional layer of protection to each of the inflatable members 110, the user and the patient when the device 200 is being used as a stretcher. More specifically, the protective layer 140 is preferably comprised of a plurality of detached or detachable layers of a ballistic-resistant material including, but not limited to, a Kevlar® material, thereby enabling the user (not shown) to also use the device 200 as a one-handed defensive or offensive shield. The Kevlar® material is preferably layered in such a manner as to possess a minimum ballistic resilience rating of NIJ IIIA, though the invention is not limited thereto.

For example, in an offensive setting, a user may use the device 200, with the protective layer 140 being positioned between the enemy and the inflatable members 110, as a one-handed offensive shield (e.g., the user can position his or her forearm through the handles 152 of the lateral strap assembly 150, or use the handles 210 positioned along the rear surface of one of the inflatable panels 110) and enabling the user to use his or her other hand to, for example, return fire to an enemy. Additionally, because the protective layer 140 is preferably comprised of a plurality of detached or detachable layers of ballistic-resistant materials, should one or more of the layers become damaged, the damaged layers can be relatively easily replaced without having to discard the entire protective layer 140, which could be both time-consuming and expensive. By way of example and not limitation, it is contemplated that the protective layer 140 could be comprised of approximately twenty-four layers of Kevlar® material. Also, the immediately adjacent presence of the inflatable member 110 helps to absorb and distribute the shock and impact forces of small arms fire and other projectiles, thereby reducing the potential for damage to the protective layer 140 and end user soft tissue damage.

As best shown in FIGS. 2-3, 12 and 13, the lateral strap assembly 150 is preferably an elongated nylon strap that can be positioned in a cross-member configuration along, and attached to, the protective cover 130 to form a plurality of handles 152. The handles 152 can be used to transport an injured individual, such as a soldier, off of the battlefield, when the device 200 is being used as a stretcher. Further, as best shown in FIGS. 2, 3 and 12, the longitudinal strap assembly 160 is also preferably an elongated nylon strap that can be positioned longitudinally along, and attached to, the protective cover 130 to form an additional handle 152 that can be used to pull device 100 longitudinally. Alternatively, it is also contemplated that additional (or fewer) lateral straps/handles and longitudinal straps/handles can be used with the device 200 (see e.g., handles 200 referenced with respect to the discussion of FIG. 13 below). Each of the lateral strap assembly 150 and the longitudinal strap assembly 160 can be attached to the protective cover 130 by any means commonly known in the art, such as via stitching, adhesives, plastic welding, etc.

Figure 13:
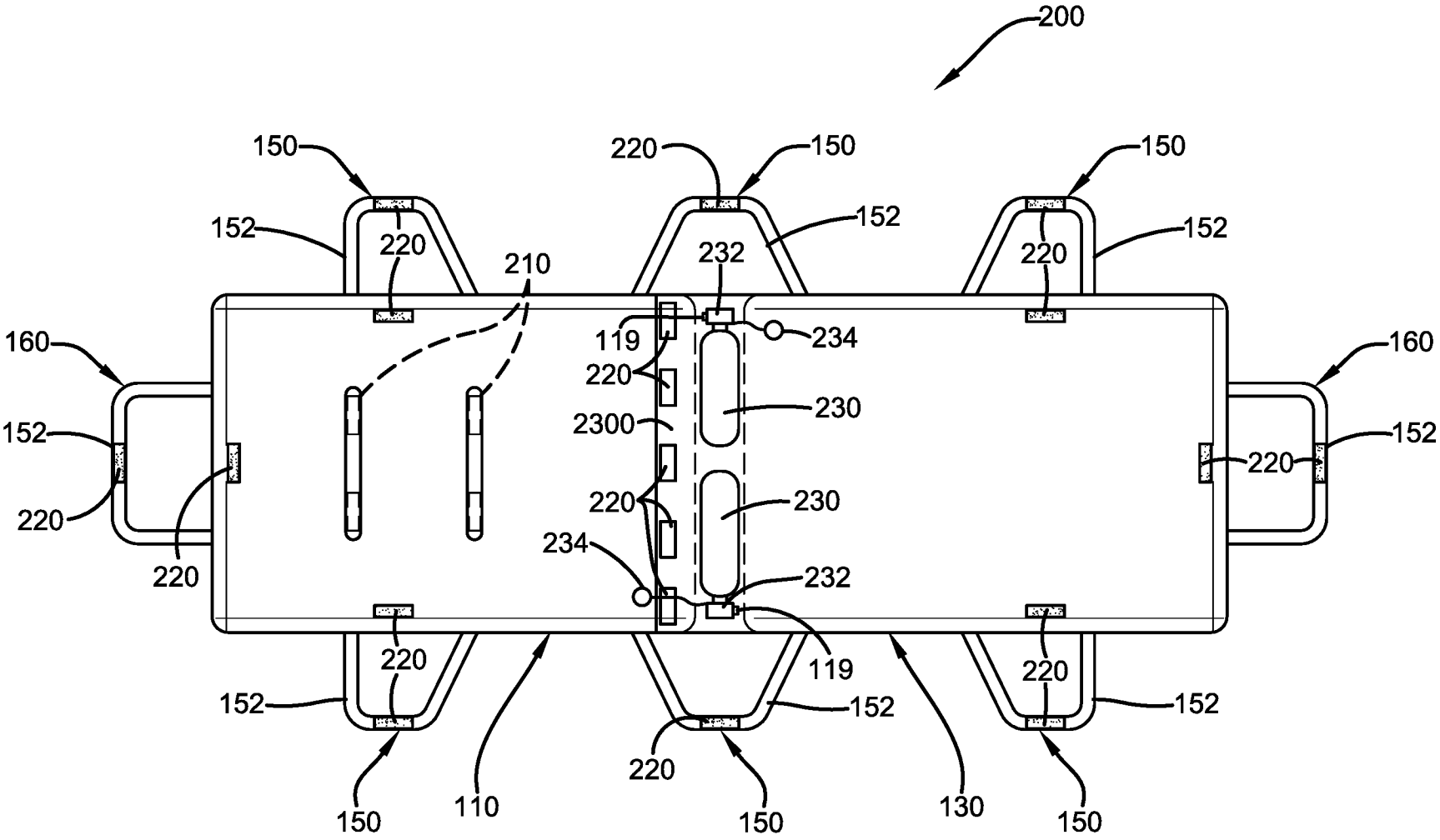
FIG. 13 illustrates a rear view of an alternative embodiment of a portable ballistic shield and stretcher device of the present invention.

FIG. 13 illustrates a rear view of an alternative embodiment of a portable ballistic shield and stretcher device 200 of the present invention, wherein the inflation means and fastening systems are on full display. As noted above, the device 200 is preferably comprised of two inflatable panels 110, each of which may be selectively inflated or deflated to satisfy the wants or needs of the user (not shown). The inflation means is preferably one or more compressed or liquified gas cylinders 230, substantially the same as those described above, in fluid communication with the inflatable panels 110 via a regulator 232 and/or a valve 236 that may be activated when the user pulls an inflation cord 234. More specifically, the user may use the valve 236 to control which of the inflatable panels 110 is inflated first, and may use the regulator 232 to control the inflation or deflation thereof. Additionally, the regulator 232 may function similarly to that of the valve mode selector 174 described above. Alternatively, and as also described above, a manual inflation means, such as a portable pump or other air supply can also be used to inflate the inflatable panels 110. As shown, the inflation means is preferably positioned between each of the inflatable panels 110, so as to be easily accessible to either or both of the inflatable panels, but still be protected by the protective layer 140. The inflation means may be protected by a repositionable flap 2300.

As also best shown in FIG. 13, a plurality of fasteners 220 may be positioned along the surface of the protective cover 130, handles 152, 210, etc. to attach the handles 152 to the protective cover 130 when the same are not in use to eliminate potential tripping hazards, and so as to not interfere with the interconnect-ability of the various devices 200 as described more fully below. The fasteners 220 are preferably hook and loop type fasteners, but the device 200 of the present invention is not so limited, and any other suitable fasteners may also be used including, without limitation, snaps, buttons and the like. The plurality of fasteners 220 may also be used to retain the repositionable flap 2300 in a desired location relative to the inflation means.

The inflatable panels 110 and the protective layer 140 are preferably held in place by the presence of the protective cover 130. The protective layer 140 extends across both of the inflatable panels 110 without any gaps therein. As described above, and best shown in FIG. 13, one or more handles 210 may be positioned along the rear portion of the protective cover 130 to enable the user (not shown) to single-handedly maneuver the device 200. More specifically, the device 200 may be used as a one-handed offensive shield by positioning his or her forearm through the handles 210 positioned along the rear surface of the protective cover 130, thereby enabling the user to use his or her other hand to, for example, return fire to an enemy.

Figure 14:
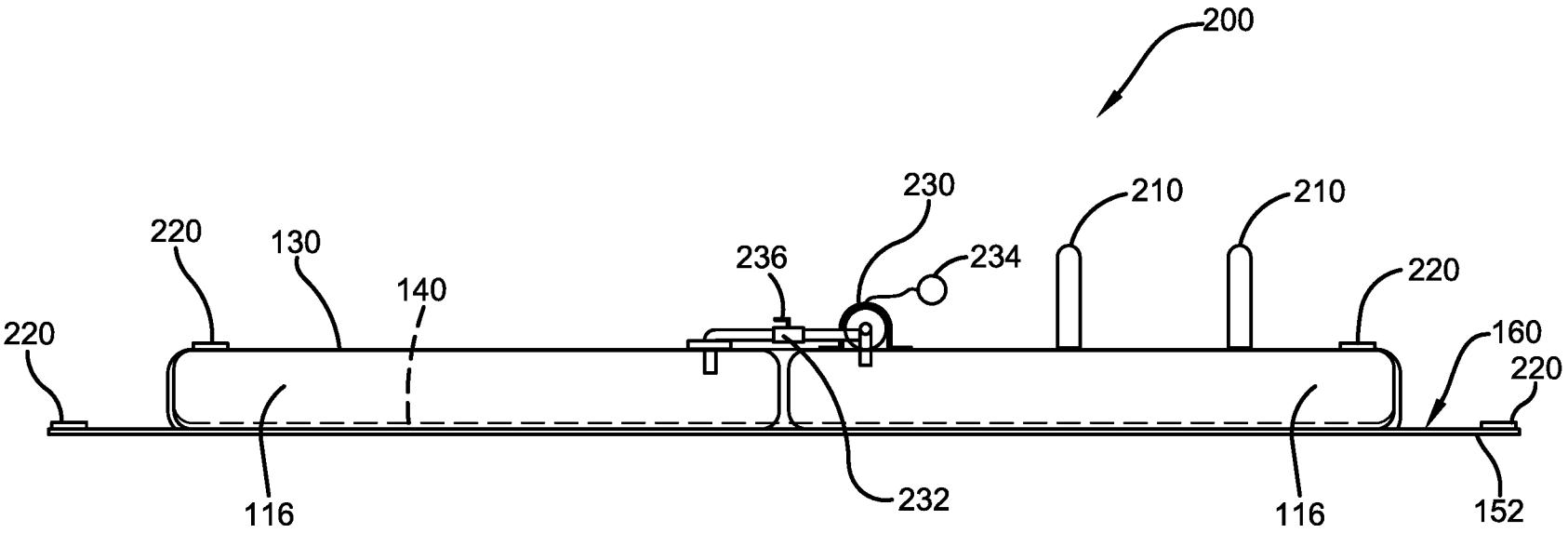
FIG. 14 illustrates a side view of an alternative embodiment of a portable ballistic shield and stretcher device of the present invention in an inflated condition.

FIG. 14 illustrates a side view of an alternative embodiment of a portable ballistic shield and stretcher device 200 of the present invention in an inflated condition. In this embodiment, the inflation means is attached to the rear surface 114 of one or more of the inflatable panels 110, as opposed to between the same. Similarly, the handles 210 are also attached to the rear portion 114 of the protective cover 130 to enable the user (not shown) to single-handedly use the device 200, as described above. The fasteners 220 present on the handles 152 to correspond with those fasteners 220 present on the rear 114 of the protective cover 130 are also clearly visible in FIG. 14.

Figure 15:
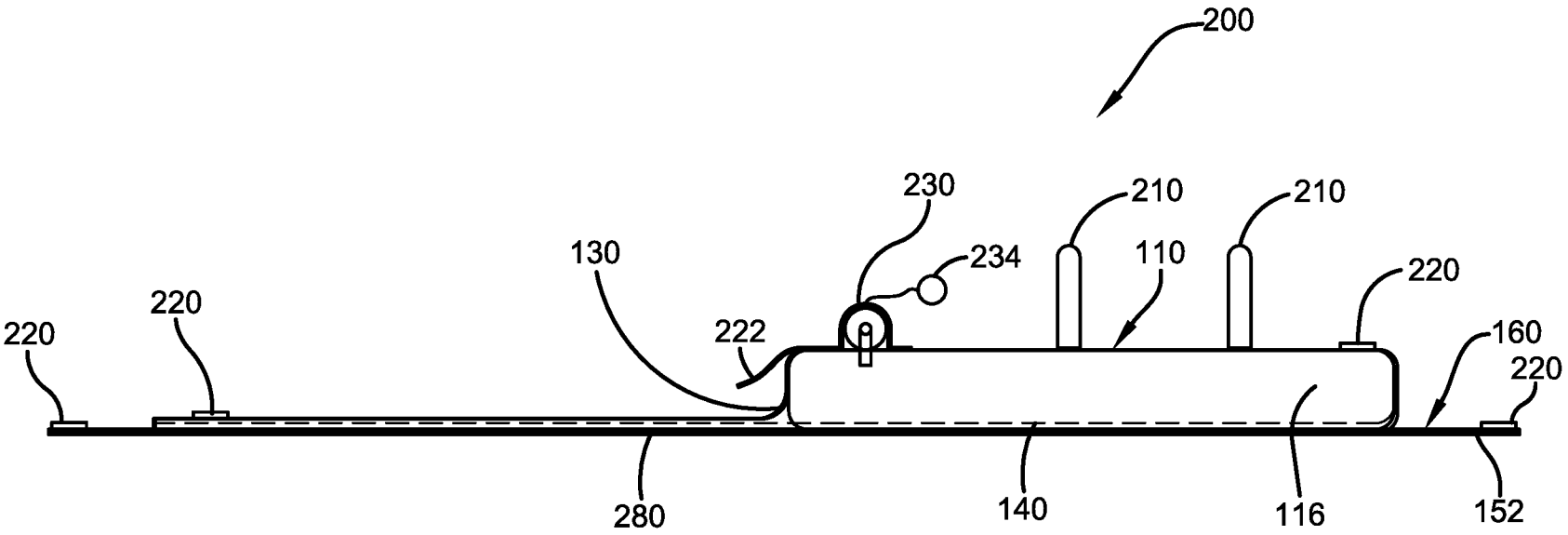
FIG. 15 illustrates a side view of an alternative embodiment of a portable ballistic shield and stretcher device of the present invention, wherein only one of the panels of the device is in an inflated condition.

FIG. 15 illustrates a side view of an alternative embodiment of a portable ballistic shield and stretcher device 200 of the present invention, wherein only one of the inflatable panels 110 of the device 200 is in an inflated condition. More specifically, as shown, only the upper of the two inflatable panels 110 is inflated using the inflation means, and the lower inflatable panel 110 is in a deflated condition. Importantly, even while the lower inflatable panel 110 is deflated, the presence of the protective layer 140 along the front 112 of the deflated inflatable panel 110 may act as a ballistic blanket (whether inflatable or not) and protect the user from arms fire and other harmful projectiles.

As also shown in FIG. 15, the device 200 may further comprise a relatively thin sheet or sheets of spring steel 280 that extends along the entire front surface of the device. The steel sheet 280 preferably has a Rockwell hardness number of C50 and a thickness of 0.005" to 0.015" based upon how many layers/sheets used and the desired ease with which the device 200 can be rolled up. The number of layers/sheets of steel 280 also increases the ballistic rating. In use, the steel sheets/layers 280 will spring open and lay flat without having to inflate the device 200. However, like before, inflation will add further rigidity to the device 200 and reduces the likelihood of injury to the user. The hardened steel 208 also slows the bullet down and blunts the tip so that the ballistic cloth is more effective and can stop larger caliber rounds at a closer range.

Figure 16:
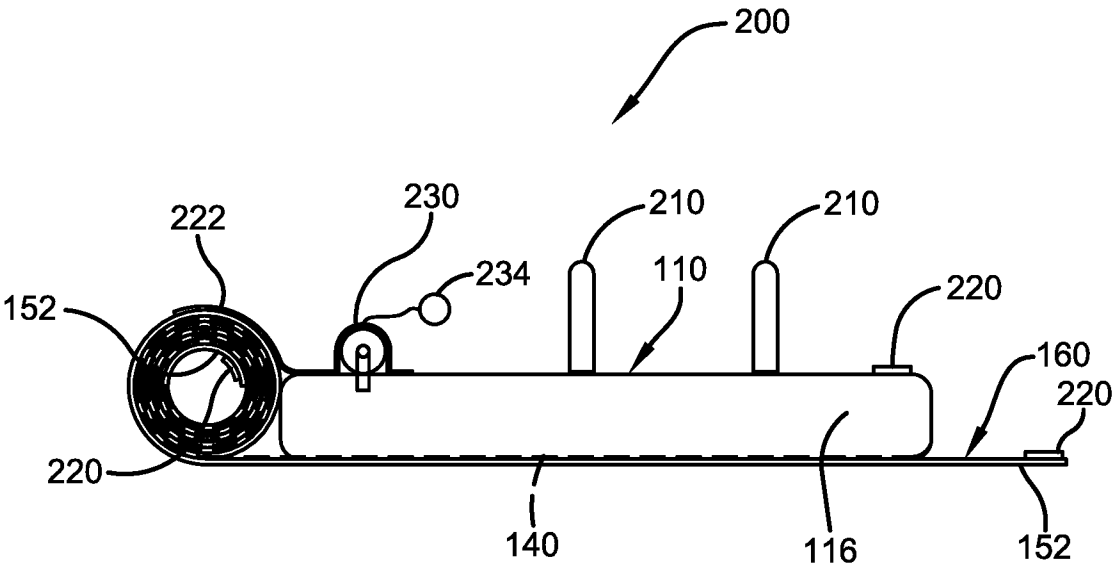
FIG. 16 illustrates a side view of an alternative embodiment of a portable ballistic shield and stretcher device of the present invention, wherein only one of the panels of the device is in an inflated condition and the second panel is deflated and rolled-up for easy transportation.

FIG. 16 illustrates a side view of an alternative embodiment of a portable ballistic shield and stretcher device 200 of the present invention, wherein only one of the inflatable panels 110 of the device 200 is in an inflated condition and the second panel 110 is deflated and rolled-up for easy transportation. More specifically, as shown, only the upper of the two inflatable panels 110 is inflated using the inflation means, and the lower inflatable panel 110 is in a deflated condition and rolled up, and retained by a strap 222 with a fastener 220 thereon. Also, the lower inflatable panel 110 doesn't have to be inflatable at all, and can be merely comprised of a ballistic material. Importantly, the ability to roll up the lower inflatable panel 110 when not needed helps to make the device 200 more manageable for the user, and also eliminates a tripping hazard that may otherwise be present if the deflated panel 110 were not rolled up.

Figure 17:
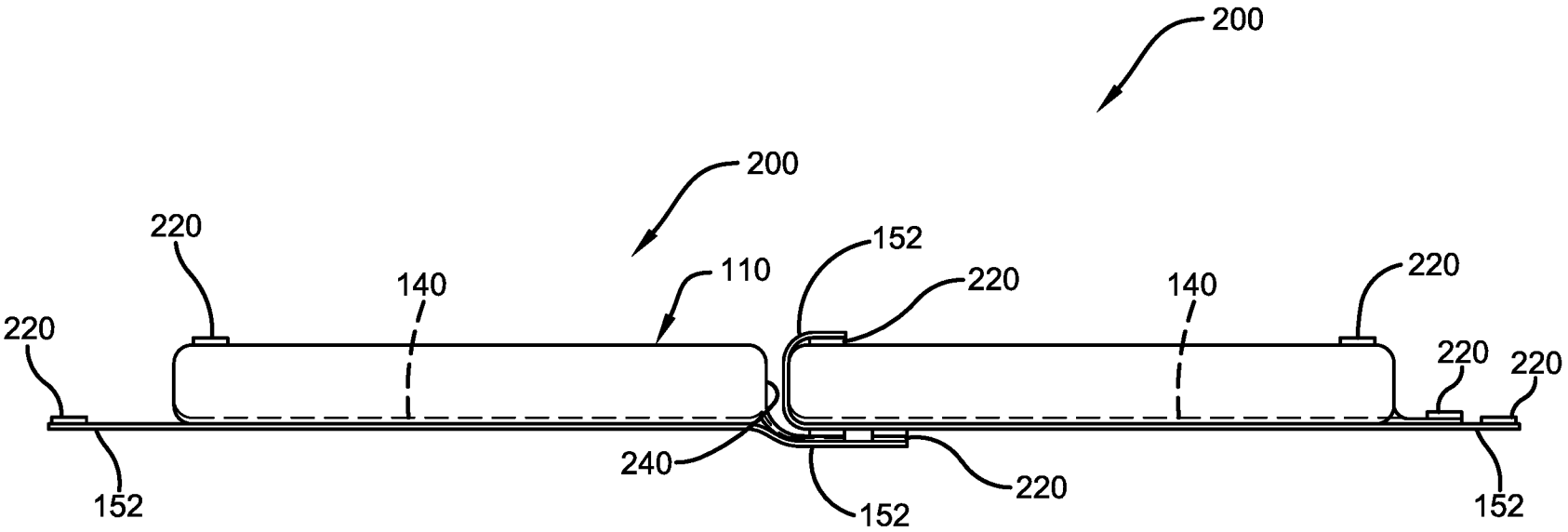
FIG. 17 illustrates a side view of an alternative embodiment of a portable ballistic shield and stretcher device of the present invention removably attached to a second portable ballistic shield and stretcher device, wherein both devices are in an inflated condition.

FIG. 17 illustrates a side view of an alternative embodiment of a portable ballistic shield and stretcher device 200 of the present invention, removably attached to a second portable ballistic shield and stretcher device 200, wherein both devices 200 are in an inflated condition. More specifically, as shown, two separate devices 200, each having a single inflatable panel 110, may be positioned in series to one another, wherein the fastener 220 of a handle strap 152 of one of the first inflatable panel 110/device 200 may be in a stowed position (i.e., removably attached to a fastener 220 on the same inflatable panel 110) and a fastener 220 of a handle strap 152 or flap of the protective cover 140 of the second inflatable panel 110/device 200 may be stretched over the gap 240 between the two devices 200, and removably attached to a fastener 220 on the first inflatable panel 110/device 200. In this manner, the entire front or forward-facing surface of the combined devices 200 is protected from arms fire and other harmful debris by the protective cover 140, and any number of devices 200 can be, for example, placed in series with, and removably attached to, one another to form a larger temporary barrier.

Figure 18:
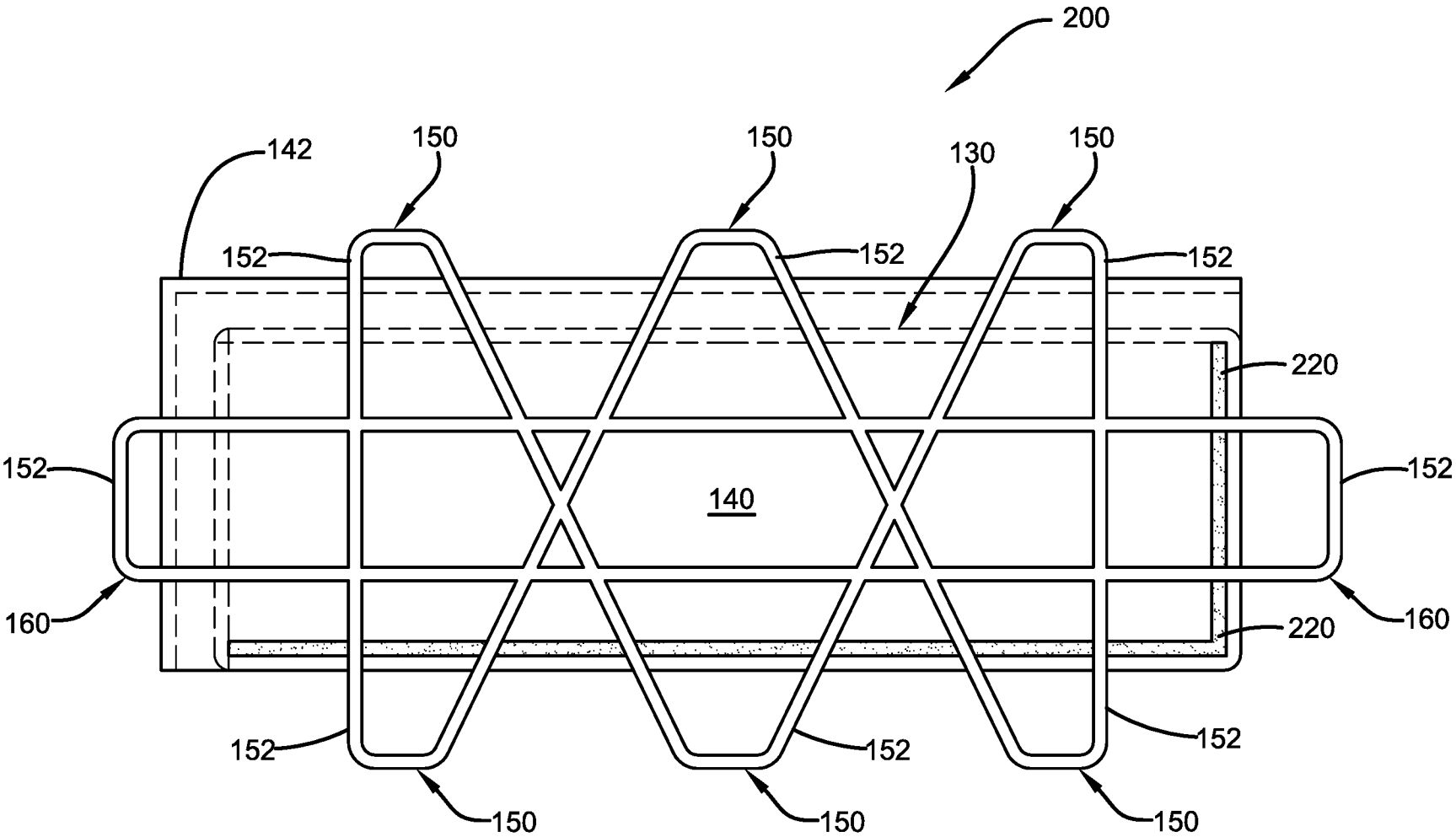
FIG. 18 illustrates a front view of an alternative embodiment of a portable ballistic shield and stretcher device of the present invention, wherein an attachment means is positioned along at least one end and at least one side of the exterior surface.

FIG. 18 illustrates a front view of an alternative embodiment of a portable ballistic shield and stretcher device 200 of the present invention, wherein an attachment means is positioned along at least one end, and at least one side of the exterior surface. More specifically, as shown, an elongated fastener 220, such as a strip or length of hook and loop fasteners, may extend along a substantial length of at least one side and at least one end of the front of the device 200, and a second elongated fastener 220, such as a strip or length of hook and loop fasteners, may extend along a substantial length of at least one side and at least one end of the rear of the flap 142 of the protective cover 140 of the device 200, so that two devices 200 may be removably attached to one another thereby.

Figure 19A:
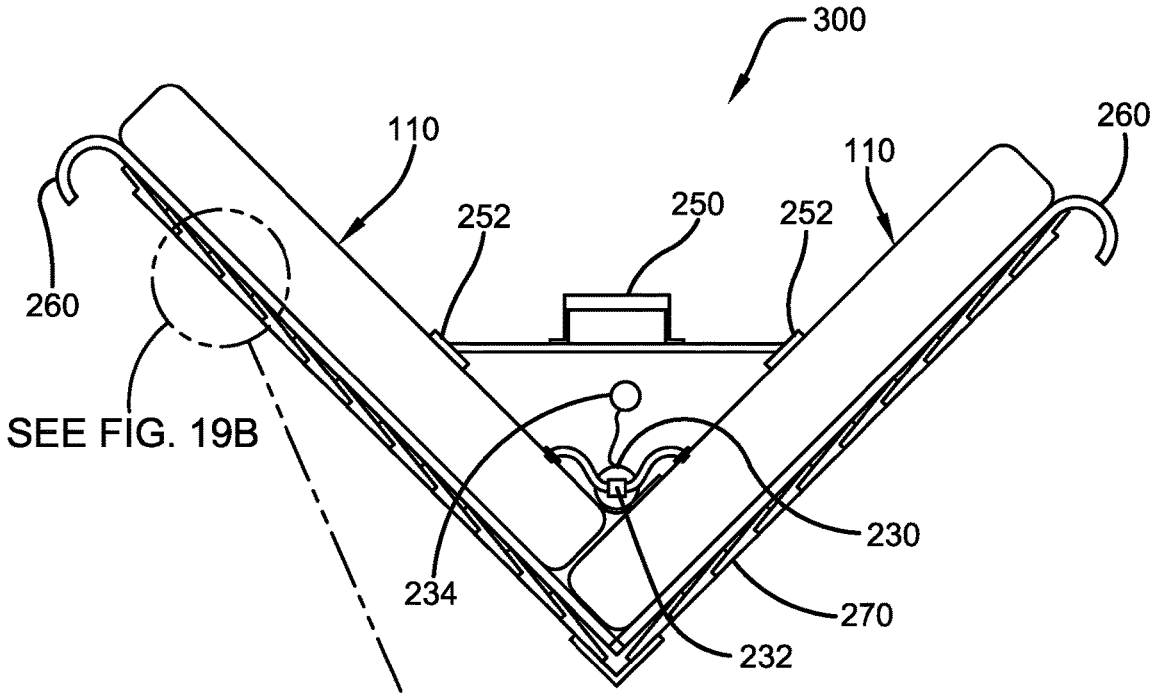
FIG. 19A illustrates a side view of an alternative embodiment of a portable ballistic shield and stretcher device of the present invention in an inflated condition, wherein the two inflatable panels are positioned at an angle to one another and have a shingled protective layer.
Figure 19B:
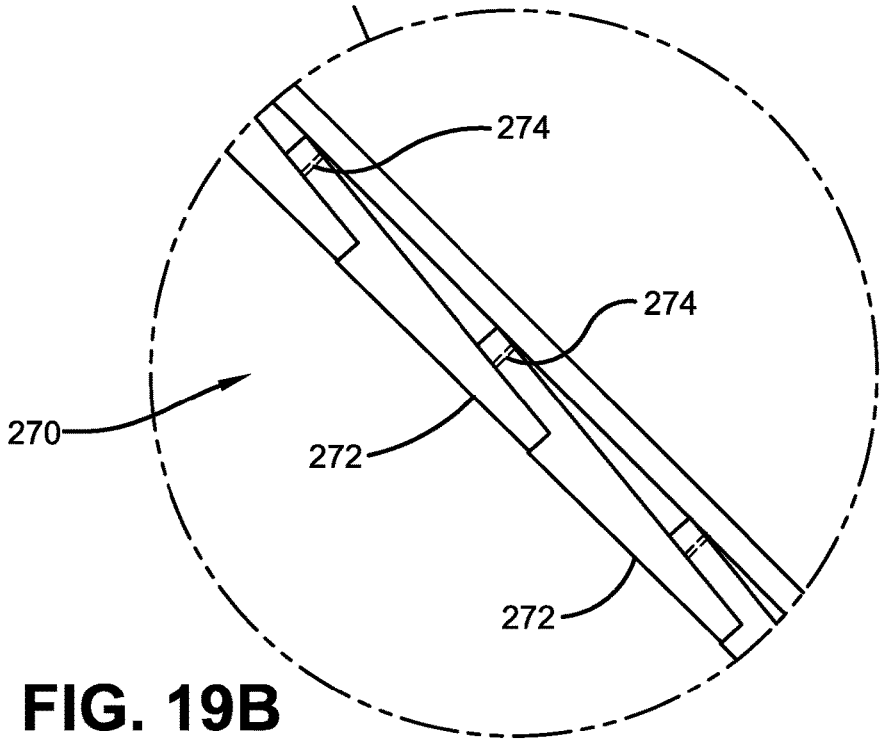
FIG. 19B illustrates a close-up view of the shingled protective layer of the portable ballistic shield and stretcher device of the present invention.

FIG. 19A illustrates a side view of an alternative embodiment of a portable ballistic shield and stretcher device 300 of the present invention in an inflated condition, wherein two inflatable panels 110 are positioned at an angle to one another and have an outer shingle-like protective layer 270. More specifically, the protective layer 270 may be comprised of a heat-treated carbon steel or other suitable material that is capable of protecting against arms fire and other harmful projectiles. The protective layer 270 is comprised of a plurality of repositionable and over-lapping shingle-like members 272 that may be notched to form a relatively smooth exterior surface (or, alternatively, a stepped exterior surface) when in a first position as best shown in FIG. 19B. However, because the plurality of repositionable and over-lapping shingle-like members 272 that are not attached to one another, the inflatable panels 110 to which they are attached may be rolled up when deflated. Each of the plurality of repositionable and over-lapping shingle-like members 272 may be attached to the inflatable panels 110 or an outer protective sleeve at a mounting point 274, as best shown in in FIG. 19B, and are easily replaceable if damaged. Alternatively, the repositionable and over-lapping shingle-like members 272 may be replaced with a ballistic resistant material.

As also depicted in FIG. 19A, the portable ballistic shield and stretcher device 300 is further comprised of a handle assembly 250, an inflation means and one or more projectile catchers or hooks 260. The handle assembly 250 may be mounted between, and to each of, the inflatable panels 110 via a pair of handle mounts 252 and enables the user (not shown) to handle the device 300 with a single hand. In this manner, the other hand of the user is free to perform other tasks such as, without limitation, returning fire to an enemy or pulling a fallen comrade.

The inflation means is preferably one or more compressed gas cylinders 230, substantially the same as those described above, in fluid communication with the inflatable panels 110 via a regulator 232 and/or a valve 236 that may be activated when the user pulls an inflation cord 234. More specifically, the user may use the valve 236 to control whichever of the inflatable panels 110 is inflated first, and may use the regulator 232 to control the inflation or deflation thereof. Additionally, the regulator 232 may function similarly to that of the valve mode selector 174 described above. Alternatively, and as also described above, a manual inflation means, such as a portable pump or other air supply can also be used to inflate the inflatable panels 110. As shown, the inflation means is preferably positioned between each of the inflatable panels 110, near their intersection, so as to be easily accessible to either or both of the inflatable panels, but still be protected by the protective layer 270.

As also depicted in FIG. 19A, the portable ballistic shield and stretcher device 300 is further comprised of a pair of bullet catchers or hooks 260 positioned at the ends of each of the inflatable panels 110 furthest from their intersection. As bullets and other projectiles strike the protective layer 270 and are ricocheted in the direction of the hooks 260, the hooks 260 will largely dissipate the energy of said bullets and projectiles and cause the same to drop to the ground, thereby further reducing the risk to those individuals or troops positioned rearward of the device 300.

Notwithstanding the forgoing, the improved medical backboard device 100 and portable ballistic shield device 200, 300 of the present invention and their various components can be of any suitable size and configuration as is known in the art without affecting the overall concept of the invention, provided that it accomplishes the above-stated objectives. One of ordinary skill in the art will appreciate that the size, configuration and material of the improved medical backboard and shield devices 100, 200, 300 and their various components as shown in the FIGS. are for illustrative purposes only, and that many other sizes of the backboard and shield devices 100, 200, 300 are well within the scope of the present disclosure. Although the dimensions of the backboard and shield devices 100, 200, 300 and their various components are important design parameters for user convenience, the backboard and shield devices 100, 200, 300 and their components may be of any size that ensures optimal performance during use and/or that suits user need and/or preference.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A ballistic shield and stretcher device comprising:
at least one inflatable member;
an inflation means;
a protective layer comprising a plurality of detachable layers of a ballistic resistant material;
an attachment means for removably attaching the ballistic shield and stretcher device to a second ballistic shield and stretcher device; and
wherein the at least one inflatable member comprises a top, a bottom and a plurality of filaments configured to span an interior of the inflatable member between the top and the bottom; and
wherein the plurality of filaments are placed in tension keeping the medical backboard device planar when the inflatable member is inflated.

2. The ballistic shield and stretcher device of claim 1, wherein the at least one inflatable member is further comprised of a first inflatable panel and a second inflatable panel.

3. The ballistic shield and stretcher device of claim 2, wherein the protective layer extends across an exterior surface of each of the first and second inflatable panels and beyond said exterior surfaces in at least two directions to form a flap.

4. The ballistic shield and stretcher device of claim 1 further comprising at least one strap assembly.

5. The ballistic shield and stretcher device of claim 2, wherein the inflating means is comprised of at least one of a container of compressed gas or a pump assembly.

6. The ballistic shield and stretcher device of claim 5, wherein the inflation means is further comprised of a valve that is in fluid communication with each of the first inflatable panel and the second inflatable panel.

7. The ballistic shield and stretcher device of claim 6, wherein the valve is comprised of an inlet, an outlet and a mode selector, and further wherein the valve can be used to selectively inflate at least one of the first inflatable panel and the second inflatable panel.

8. The ballistic shield and stretcher device of claim 1, wherein the attachment means is comprised of at least one of a hook and loop fastener, a snap, a zipper, a male/female connector or a combination thereof.

* * * * *